US007097889B1

(12) United States Patent
Carroll

(10) Patent No.: US 7,097,889 B1
(45) Date of Patent: Aug. 29, 2006

(54) ARTIFICIAL BARREL CACTUS

(75) Inventor: Eric J. Carroll, Valley Center, KS (US)

(73) Assignee: Desert Steel Company, Wichita, KS (US)

( * ) Notice: Subject to any disclaimer, the term of this patent is extended or adjusted under 35 U.S.C. 154(b) by 0 days.

(21) Appl. No.: 10/928,967

(22) Filed: Aug. 27, 2004

(51) Int. Cl.
*A41G 1/00* (2006.01)

(52) U.S. Cl. ..... 428/17; 428/15; 428/18

(58) Field of Classification Search ..... 428/15, 428/17, 18, 33, 542.2
See application file for complete search history.

(56) References Cited

U.S. PATENT DOCUMENTS 5,213,855 A * 5/1993 Buxton ..... 428/17
5,629,057 A * 5/1997 Wang et al. ..... 428/9
D413,001 S * 8/1999 Nowosielski ..... D26/101
6,343,440 B1 2/2002 Ayers
D477,546 S 7/2003 Como

OTHER PUBLICATIONS

Merriam Webster On-Line—http//www.m-w.com/cgi-bin/dictionary Jun. 6, 2005.*
websites—http://www.www.mainlandmart.com/cactus.html Jun. 6, 2000□□.*
websites—http://www.madesigns.biz Jun. 9, 2005□□http://www.budtoblooms.com Jun. 9, 2005—□□http://qualitysilkplants.com Jun. 9, 2005.*
website—http://www.amazonfoliages.com Jun. 9, 2005.*

* cited by examiner

*Primary Examiner*—Deborah Jones
*Assistant Examiner*—Elizabeth D. Ivey
(74) *Attorney, Agent, or Firm*—Kenneth Jack; Davis & Jack, LLC

(57) ABSTRACT

An artificial barrel cactus consisting of a plurality of sickles; and a plurality of welds laterally interconnecting and radially arranging the sickles about a vertical axis.

17 Claims, 4 Drawing Sheets

ARTIFICIAL BARREL CACTUS

FIELD OF THE INVENTION

This invention relates to structural combinations and assemblies whose function is the three dimensional depiction or portrayal of plants. More particularly, this invention relates to such assemblies and combinations which depict Ferocacti, or barrel cacti.

BACKGROUND OF THE INVENTION

Barrel cacti, genus *Ferocactus*, are typically spherical or cylindrical. Such cacti have prominent radially arranged and vertically or longitudinally extending ribs. Horizontal cross sections of such ribs are typically "V" shaped and the apexes of the ribs are typically armed with sharp spines. Immature barrel cacti are typically spherical, while mature barrel cacti may assume a more cylindrical shape, ranging in height between four and eleven feet. Barrel cacti are typically long lived and their unique shape makes them highly desirable for use in landscaping and decoration of outdoor lawn and patio spaces.

In North America, barrel cacti grow only in Southern Arizona, Southern New Mexico, Southern California, Southern Nevada, Southwestern Utah, West Texas and Mexico. In more northerly, less arid areas of North America, Barrel cacti tend to suffer water damage, yellowing and rotting or bloating and cracking. Notwithstanding, barrel cactus are desirably utilized for decorative landscaping regardless of climate. Accordingly, it is desirable to provide a mechanically simply constructed and economically constructed artificial barrel cactus.

The instant inventive artificial barrel cactus solves problems and serves needs as described above by providing for a novel and unique combination of radially arranged sickle elements, for forming a structure which portrays or suggests in three dimensions the appearance of a natural barrel cactus.

BRIEF SUMMARY OF THE INVENTION

Basic structural units or components of the instant inventive artificial barrel cactus comprise cactus rib or valley depicting sickles, each having a convex inner edge or a plurality of convex inner edges, and each having a concave outer edge or a plurality of concave outer edges. The curvatures of such inner and outer edges preferably match longitudinal or vertically extending curvature lines of the ribs of natural barrel cacti.

In a preferred embodiment of the instant invention, each rib or valley depicting sickle element comprises a crescent plate which is preferably composed of flexible sheet steel. Suitably, the crescent plates may alternately comprise other metals such as tin, brass, aluminum, or copper. Also suitably, the crescent plates may alternately comprise plastic, fiberglass sheets, wood sheets, composite board or cardboard. Where the type of barrel cactus which is depicted or portrayed by the instant invention is substantially spherical, each of such crescent plates sickles preferably has a substantially circular outer edge curvature. Where such barrel cactus type is tall and cylindrical, such crescent plate sickles are preferably configured to include substantially straight lower sections with pronounced curvature occurring only at the sickles' upper ends.

In fabricating the instant inventive artificial barrel cactus, the rib or valley depicting sickle units are preferably paired. Outer edge plate attaching means are preferably provided, such means interconnecting pairs of the crescent plates to form a plurality of ribs. The outer edge attaching means preferably splay the inner edges of paired crescent plates away from each other, so that each pair of plates has a substantially "V" shaped lateral cross section. In lieu of welded attachments of the outer edges of the preferred crescent plate sickle elements, such elements may suitably alternately comprise faces of fanned and accordion folded metal sheets, the creases or folds between the faces constituting wholly formed joints. Sheet metal pressing processes may be utilized to achieve such accordion folds. Suitably, the outer edge attaching means may further alternately comprise adhesive bonds or other commonly known connecting means.

A further component of the instant inventive artificial barrel cactus comprises sickle attaching means, such means laterally interconnecting and radially arranging the sickles about a vertical axis. The inner edges of the preferred single faced crescent plates are preferably formed to present a coffered series of tabs and insets. Where such inner edge configuration is utilized, inwardly extending distal ends of such tabs advantageously provide points of lateral contact between the radially arranged sickles. A preferred sickle attaching means comprises welds which laterally interconnect the sickles at abutting or overlapping distal ends of such tabs. Alternately, the sickle attaching means may comprise adhesive bonds, rivet and aligned eyes combinations, helically threaded nut, helically threaded bolt, and aligned eyes combinations, sheet metal screws, crimped joints, interfolded joints, staples, or other commonly known attaching means.

Upon radial arrangement and lateral interattachment as described above, the plural sickle elements form a barrel cactus suggesting radial series which consists of alternating ribs and valleys. Preferably, light emitting apertures extend through the floor of each valley, providing enhanced visual definition to the ribs and valleys during daylight. In darkness, light from a light source may advantageously emanate from such apertures for illuminating outer surfaces of the artificial barrel cactus.

Accordingly, an object of the instant invention is the provision of a mechanically simply and economically constructed artificial barrel cactus which incorporates a plurality of radially arranged sickle elements. Other and further objects, benefits, and advantages of the present invention have been described above and are further described in the Detailed Description and appended drawings which follow.

DETAILED DESCRIPTION OF A PREFERRED EMBODIMENT

Figure 1:
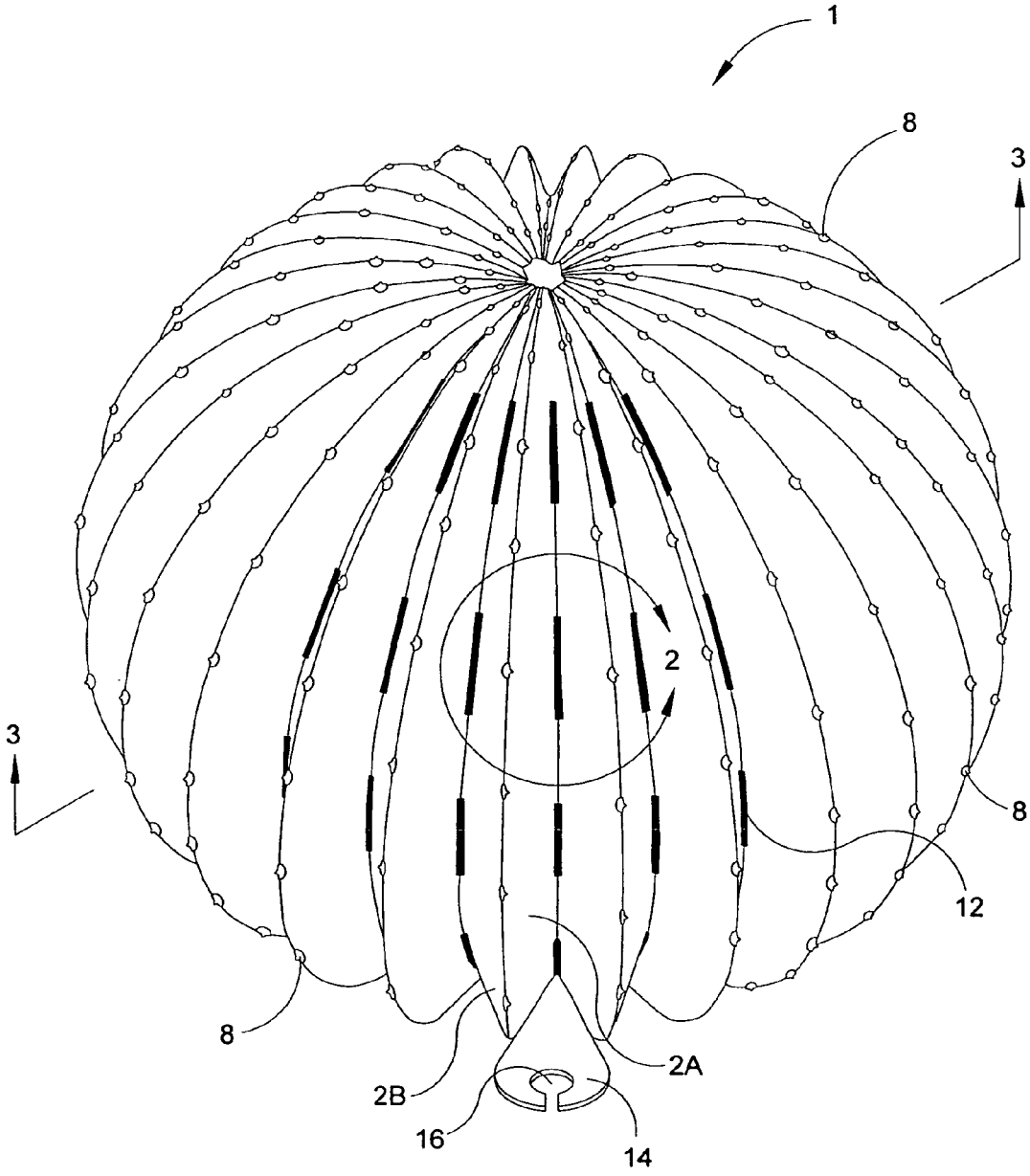
FIG. 1 is an isometric view of a preferred embodiment of the instant inventive artificial barrel cactus.
Figure 2:
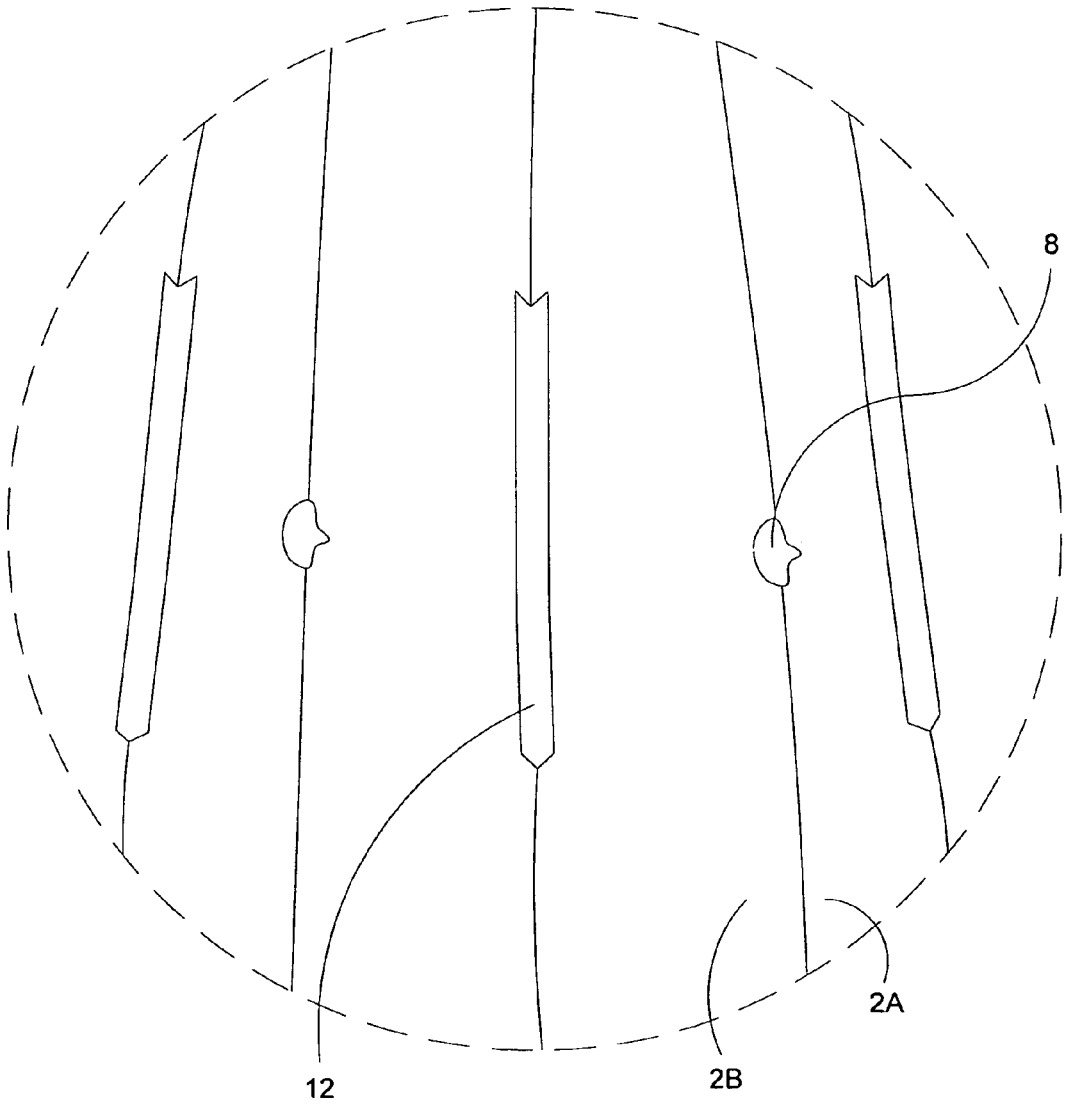
FIG. 2 is a magnified view of a portion of the view of FIG. 1, as indicated in FIG. 1.
Figure 3:
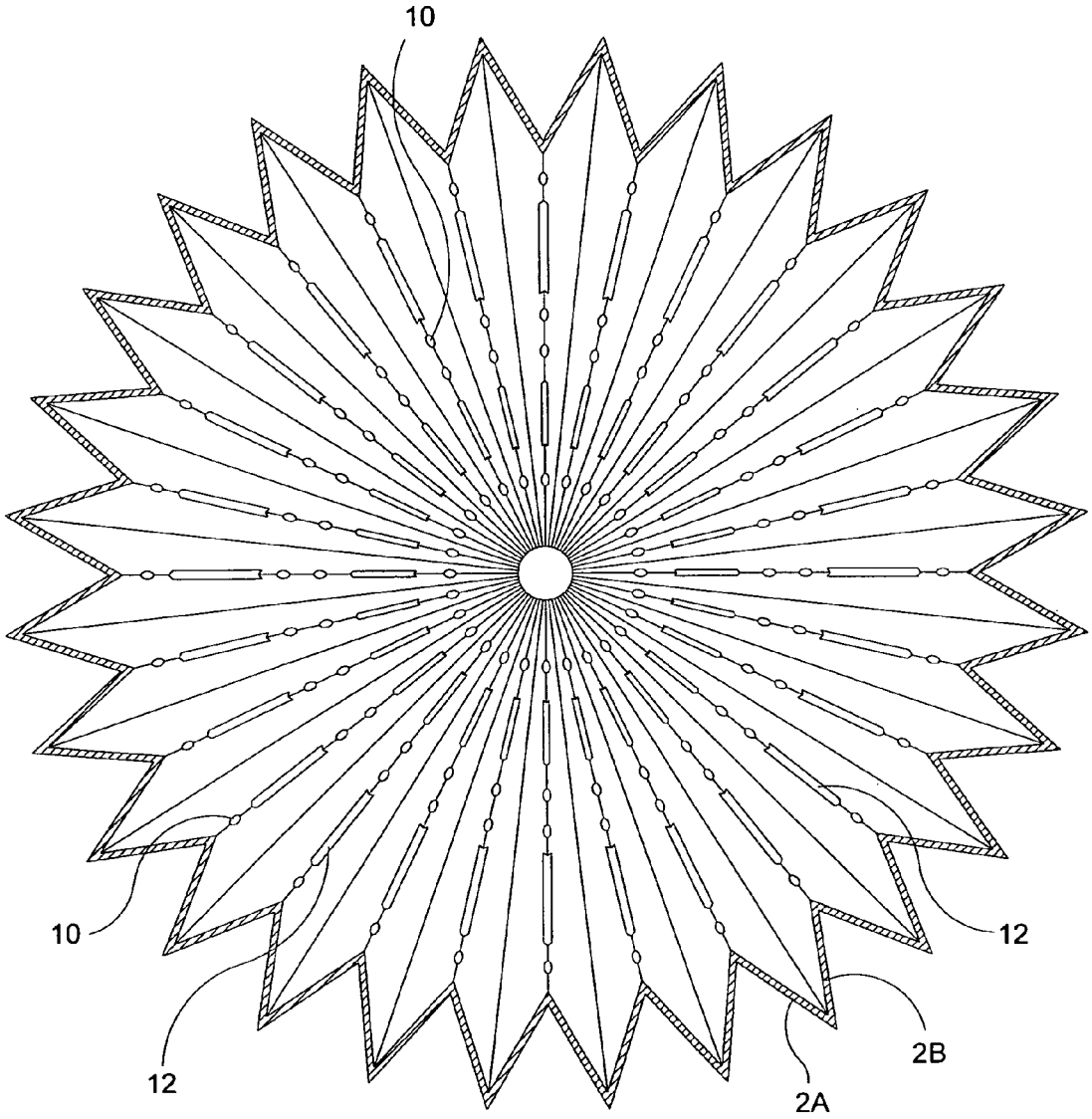
FIG. 3 is a sectional view as indicated in FIG. 1
Figure 4:
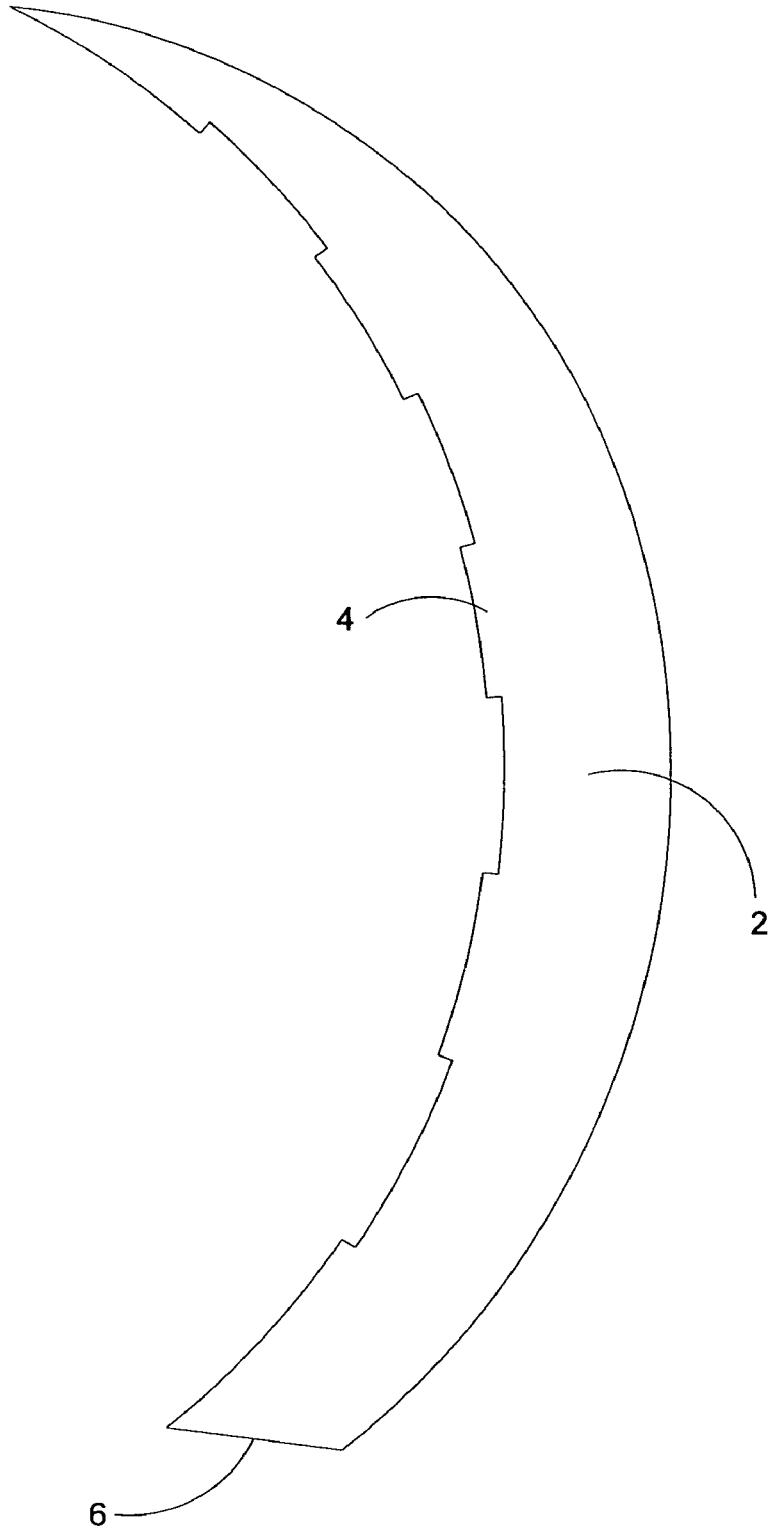
FIG. 4 is a view of a single crescent plate sickle element of the instant invention.

Referring now to the drawings, and in particular to FIG. 1, a preferred embodiment of the instant inventive artificial barrel cactus is referred to generally by Reference Arrow 1. Referring further to FIG. 4, the basic structural element or unit of the artificial barrel cactus 1 comprises a sickle 2 having a convex inner edge, and having a concave outer edge. Referring further simultaneously to FIGS. 2 and 3, paired sickles 2A and 2B form a cactus rib. Suitably, the sickle elements of the instant invention may alternately comprise stamped or pressed formations of rib faces 2A and 2B. Also, suitably, the sickle elements may comprise stamped or pressed formations of adjacent rib faces, each unitary sickle element defining a single valley as opposed to a single rib. Also suitably, though less desirably, the unitary sickle elements may alternately comprise stamped or pressed members which depict multiple ribs and valleys. The accordion creased and faces of the artificial barrel cactus 1 depicted in FIG. 1 is representative of each of the types of unitary sickle elements discussed above.

Referring to FIG. 4, each of the preferred single faced sickles 2 of the instant inventive barrel cactus has a horizontally truncated lower end 6 which, in combination with the lower ends of other sickles 2 forms a horizontal mounting surface.

Referring simultaneously to FIGS. 1, 2, and 4, the curved outer edges of the preferred paired sickles 2 are preferably interconnected by attaching means which preferably comprise welds 8. Such welds preferably laterally splay the inner edges of each pair of sickles 2.

Each of the sickles 2 preferably comprises flexible sheet steel. Also preferably, the welds 8 hold the paired sickles 2 in the "V" shaped or splayed configurations depicted in FIG. 1. In such splayed configurations, the degrees of curvature of the outer edges of the sickles 2 are slightly greater than their flat plane curvatures as depicted in FIG. 4. Such differentials in curvature desirably and advantageously effect such lateral splaying of the sickles' inner edges forming and depicting cactus ribs. Suitably, the sickle outer edge attaching means may alternately comprise adhesive bonds.

Referring simultaneously to FIGS. 1 and 3, sickle attaching means are necessarily provided, such means laterally interconnecting the basic sickle units of the artificial barrel cactus 1. Such attaching means preferably arranges and orients the sickle units radially about a vertical axis. A preferred sickle attaching means comprises welds 10. Suitably, such means may alternately comprise any of numerous other commonly known sheet material seam bonding means such as adhesives (not depicted), rivet and aligned eyes combinations (not depicted), helically threaded nut, bolt and aligned eyes combinations (not depicted), sheet metal screws (not depicted), crimped joints (not depicted), interfolded joints (not depicted), or staples (not depicted).

Referring to FIG. 4, the inner edge of each of the preferred sickle plates 2 is coffered, forming a series of alternating inwardly opening recesses and inwardly extending tabs 4. Referring simultaneously to all figures, the preferred coffered tabs 4 of the sickle units are preferably laterally and radially aligned to form vertically oblongated light emitting ports 12. During daylight hours, such light emitting ports 12 advantageously darken and give additional visual depth and definition to the radial array of "V" shaped valleys formed by the radial array of sickles 2. Alternately, in darkness, and assuming that a light source such as an incandescent bulb or candle flame (not depicted), is placed within the interior space of the artificial barrel cactus 1, such ports 12 advantageously illuminate outer surfaces of the artificial barrel cactus 1.

Referring simultaneously to FIGS. 3 and 4, paired upper and lower edges of tabs 4 inversely define the upper and lower edges of light emitting apertures 12.

Referring to FIG. 2, each of the preferred crescent plate outer edge attaching welds 8 preferably is formed to include a slightly pointed protrusion which advantageously suggests or depicts a barrel cactus spine.

Referring to FIG. 1, the instant inventive artificial barrel cactus 1 preferably further comprises a fixedly attached mounting flange 14, such flange preferably having a mounting lug receiving eye 16, such flange and eye advantageously facilitating mounting of the artificial barrel cactus 1 upon a slab or floor surface, or upon mounting lug bearing posts or piers.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. An artificial barrel cactus comprising:

(a) a plurality of sickle plates, and (b) sickle plate attaching means, the sickle plate attaching means laterally interconnecting and radially arranging the sickle plates.

2. The artificial barrel cactus of claim 1 wherein each sickle plate has a pointed upper end and has a truncated lower end.

3. The artificial barrel cactus of claim 2 further comprising pluralities of tabs extending inwardly from the sickle plates.

4. The artificial barrel cactus of claim 3 wherein each sickle plate has an outer edge, and further comprising outer edge attaching means pairing the sickle plate outer edges, the outer edge attaching means comprising fasteners selected from the group consisting of welds and adhesive bonds.

5. The artificial barrel cactus of claim 4 wherein each sickle plate comprises flexible sheet metal.

6. The artificial barrel cactus of claim 5 wherein each sickle plate has a lower end, and further comprising a plurality of mounting flanges, each mounting flange being fixedly attached to and extending outwardly from at least one of the sickle plates' lower ends.

7. The artificial barrel cactus of claim 3 wherein the sickle plates form a plurality of longitudinally extending valleys, each longitudinally extending valley having a plurality of light emitting ports.

8. The artificial barrel cactus of claim 7 wherein each light emitting port is longitudinally oblongated.

9. The artificial barrel cactus of claim 7 wherein each tab has an upper edge and lower edge, wherein each light emitting port has an upper edge and lower edge, wherein each light emitting port upper edge comprises a pair of the tabs' lower edges, and wherein each light emitting port lower edge comprises a pair of the tabs' upper edges.

10. The artificial barrel cactus of claim 9 wherein the sickle plate attaching means comprise fasteners selected from the group consisting of welds, adhesive bonds, rivet and aligned eye combinations, helically threaded nut, bolt and aligned eyes combinations, sheet metal screws, crimped joints, interfolded joints, and staples.

11. An artificial barrel cactus comprising:

(a) a plurality of sickle plates, each sickle plate having a pointed upper end, having a truncated lower end, and having an outer edge;

(b) sickle plate attaching means, the sickle plate attaching means laterally interconnecting and radially arranging the sickle plates;

(c) pluralities of tabs extending inwardly from the sickle plates; and (d) outer edge attaching means pairing the sickle plate outer edges, the outer edge attaching means comprising fasteners selected from the group consisting of welds and adhesive bonds.

12. The artificial barrel cactus of claim 11 wherein each sickle plate comprises flexible sheet metal.

13. The artificial barrel cactus of claim 12 wherein each sickle plate has a lower end, and further comprising a plurality of mounting flanges, each mounting flange being fixedly attached to and extending outwardly from at least one of the sickle plates' lower ends.

14. An artificial barrel cactus comprising:

(a) a plurality of sickle plates, each sickle plate having a pointed upper end and having a truncated lower end;

(b) sickle plate attaching means, the sickle plate attaching means laterally interconnecting and radially arranging the sickle plates; and (c) pluralities of tabs extending inwardly from the sickle plates; the sickle plates forming a plurality of longitudinally extending valleys, each longitudinally extending valley having a plurality of light emitting ports.

15. The artificial barrel cactus of claim 14 wherein each light emitting port is longitudinally oblongated.

16. The artificial barrel cactus of claim 14 wherein each tab has an upper edge and lower edge, wherein each light emitting port has an upper edge and a lower edge, wherein each light emitting port upper edge comprises a pair of the tabs' lower edges, and wherein each light emitting port lower edge comprises a pair of the tabs' upper edges.

17. The artificial barrel cactus of claim 16 wherein the sickle plate attaching means comprise fasteners selected from the group consisting of welds, adhesive bonds, rivet and aligned eye combinations, helically threaded nut, bolt and aligned eyes combinations, sheet metal screws, crimped joints, interfolded joints, and staples.

* * * * *